US005240389A

United States Patent [19]

Oikawa et al.

[11] Patent Number: 5,240,389

[45] Date of Patent: Aug. 31, 1993

[54] SCROLL TYPE COMPRESSOR

[75] Inventors: Satoru Oikawa, Fuji; Toshinobu Inoue, Numazu; Akira Morishima; Yutaka Sasahara, both of Fuji, all of Japan

[73] Assignee: Kabushiki Kaisha Toshiba, Kawasaki, Japan

[21] Appl. No.: 912,717

[22] Filed: Jul. 13, 1992

[30] Foreign Application Priority Data

Jul. 26, 1991 [JP] Japan ..... 3-187908
Sep. 5, 1991 [JP] Japan ..... 3-226073

[51] Int. Cl.[5] ..... F04B 49/00
[52] U.S. Cl. ..... 417/310
[58] Field of Search ..... 417/310; 418/55.1

[56] References Cited

U.S. PATENT DOCUMENTS

| | | | |
|---|---|---|---|
| 4,383,805 | 5/1983 | Teegarden et al. | 417/310 |
| 4,456,435 | 6/1984 | Hiraga et al. | 417/310 |
| 4,497,615 | 2/1985 | Griffith | 417/310 |
| 4,717,314 | 1/1988 | Sato et al. | 417/310 |
| 4,846,633 | 7/1989 | Suzuki et al. | 417/310 |
| 4,886,425 | 12/1989 | Itahana et al. | 417/310 |
| 5,055,012 | 10/1991 | Sakashita et al. | 418/55.1 |

FOREIGN PATENT DOCUMENTS 62-105389 7/1987 Japan .
63-259104 10/1988 Japan .

*Primary Examiner*—Richard A. Bertsch
*Assistant Examiner*—Alfred Basichas
*Attorney, Agent, or Firm*—Cushman, Darby & Cushman

[57] ABSTRACT

In a scroll type compressor, a revolving scroll having a disc portion and a blade portion is engaged with a stationary scroll having a disc portion and a blade portion. A gas is introduced from the outer peripheral portions of these scrolls and compressed in a pair of compression chambers defined between the scrolls, and a compressed gas is discharged. A first inlet and a second inlet, which are connected by a communication path, are formed at positions corresponding to the compression chambers, where the gas is compressed. Release means is provided between one of the compression chambers and a gas suction unit. The release means returns part of the gas in one of the compression chambers directly to, and part of the gas in the other compression chamber via the first and second inlets, the communication path and the one of the compression chambers to, the gas suction unit simultaneously by equal degrees.

19 Claims, 8 Drawing Sheets

SCROLL TYPE COMPRESSOR

BACKGROUND OF THE INVENTION

1. Field of the Invention

The present invention relates to a scroll type compressor used in, for example, a refrigerating cycle apparatus, wherein compression chambers are formed between a stationary scroll and a revolving scroll, a refrigerant gas is sucked and compressed in the compression chambers, and the gas is discharged.

2. Description of the Related Art

Recently, scroll type compressors, among refrigerant gas compressors, have widely been used in refrigerating cycle apparatuses.

The scroll type compressor can perform a compression function with a higher efficiency than, for example, a rotary type compressor, and a valve mechanism is not required. Thus, the number of parts can be reduced, and operation noise can be decreased.

In the scroll type compressor, a rotary shaft is contained within a sealed casing, and a scroll compression mechanism for sucking and compressing a refrigerant gas is provided at one end portion of the rotary shaft.

The scroll type compression mechanism comprises a combination of a revolving scroll engaged with an eccentric portion formed integral to the rotary shaft, and a stationary scroll fixed on a support frame. The revolving scroll revolves, without rotating about its own axis.

Each of the revolving scroll and stationary scroll comprises a plate-like spiral blade portion and a disc portion (generally termed "mirror plate") formed integral to one end portion of the blade portion.

The blade portions of the revolving scroll and stationary scroll are engaged with one another, thereby defining a pair of compression chambers or compression spaces between the disc portions.

In accordance with revolution of the revolving scroll, a refrigerant gas is sucked into the peripheral compression chambers.

The volume of each chamber is gradually reduced, while shifting to the center of the spiral.

When the chambers reach the center of the spiral, the gas is compressed to a predetermined high pressure and is discharged from a discharge port facing the center of the spiral.

The problem of the above-described scroll type compressor is as follows.

The compression ratio of a regular, e.g. rotary type compressor is automatically adjusted to an optimal condition constantly in accordance with operation conditions.

By contrast, the scroll type compressor is driven at a constant compression ratio, irrespective of a variation in loads such as discharge pressure and suction pressure of the refrigerating cycle.

Under the operation conditions in which the compression ratio is too large or too small, the compression loss is high and the performance lowers.

For example, in the case where the suction pressure is high and the compression ratio is very small, the gas pressure in the compression chambers becomes extremely high and the stress on the blades of the scrolls and associated parts increases. As a result, the reliability of the compressor is degraded.

This problem can be solved by providing a so-called release mechanism which returns part of compressed gas in the compression chambers directly to a gas suction unit, thus reducing the gas pressure in the compression chambers.

A feature of the scroll compression mechanism, however, is that a pair of compression chambers are formed symmetrically. These chambers suck and compress gas simultaneously.

Thus, it is thought that two release mechanisms are provided for the respective compression chambers and the same amount of gas is released simultaneously from the respective chambers.

Only a slight difference in amount of released gas causes a pressure difference between the compression chambers, and the revolving scroll may revolve with an inclination.

Consequently, part of the revolving scroll is put in pressured contact with the stationary scroll, abrasion or damage may occur.

Thus, the release mechanism must have a relatively complex structure, and a very difficult adjustment is required to exactly release the same amount of gas from the two compression chambers.

A technique for solving this problem is disclosed in Japanese Patent Disclosure No. 63-259104. This application discloses a scroll type compressor wherein a passage for communication between a gas suction unit and a compression space is formed in a stationary scroll, and this passage is provided with a volume control valve.

Another technique is disclosed in Japanese Utility Model Application No. 62-105389. This application discloses that a pair of by-pass passages are formed in the blade-side bottom surface of a disc portion of a stationary scroll, and a communication path for connecting these by-pass passages is formed in the surface of the stationary scroll opposite to the blade-side bottom surface. The respective by-pass passages are provided with actuators for opening and closing the by-pass passages.

These techniques, however, increase the number of parts and the manufacturing cost, and it is difficult to exactly release the same amount of gas from the equal-pressure compression chambers. Thus, the reliability of control is low.

SUMMARY OF THE INVENTION

The present invention has been made in consideration of the above circumstances, and its object is to provide a scroll type compressor wherein the same amount of gas can be released exactly and simultaneously from a pair of equal-pressure compression chambers, which characterize this type of compressor, whereby the gas release efficiency is enhanced with a relatively simple structure.

According to the present invention, there is provided a scroll type compressor wherein compression chambers are formed between a stationary scroll and a revolving scroll to perform a compression function, the compressor comprising revolving means, a revolving scroll coupled to the revolving means, the revolving scroll including a disc portion and a plate-like spiral blade portion projecting from one side surface of this disc portion, a stationary scroll including a disc portion and a plate-like spiral blade portion projecting from one side surface of this disc portion, the blade portion being engaged with the blade portion of the revolving scroll, gas suction means for sucking and guiding a gas to be compressed, the gas suction means facing the outer peripheral portions of the stationary scroll and revolving scroll, gas discharge means for discharging and guiding the compressed gas, the gas discharge means facing the center of the spiral of the blade portions of the stationary scroll and revolving scroll, a first compression chamber and a second compression chamber having equal pressures constantly, which are a pair of spaces defined between the blade portion and the disc portion of the stationary scroll, on the one hand, and the blade portion and the disc portion of the revolving scroll, on the other, the first and second compression chambers taking in the gas guided from the gas suction means from outside spiral ends of the blade portions of the stationary and revolving scrolls in accordance with the revolving motion of the revolving scroll, moving towards the center of the spiral of the respective blade portions, reducing their volumes gradually, compressing the gas, and discharging the gas to the gas discharge means, a first inlet and a second inlet opening to the first compression chamber and the second compression chamber at locations where the gas is being compressed, a communication path for communication between the first and second inlets, and release means capable of opening and closing between one of the first and second compression chambers and the gas suction means, the release means returning, in the open state, part of the gas in one of the first and second compression chambers directly to, and part of the gas in the other compression chamber via the first and second inlets, the communication path and the one of the compression chambers to, the gas suction means simultaneously by equal degrees.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 3 relate to an embodiment of the present invention, in which:

FIG. 1 is a vertical cross-sectional view of a scroll type compressor;

FIG. 2 illustrates the sequence of a release operation;

DETAILED DESCRIPTION OF THE PREFERRED EMBODIMENTS

An embodiment of the present invention will now be described with reference to FIGS. 1 to 3.

Figure 1:
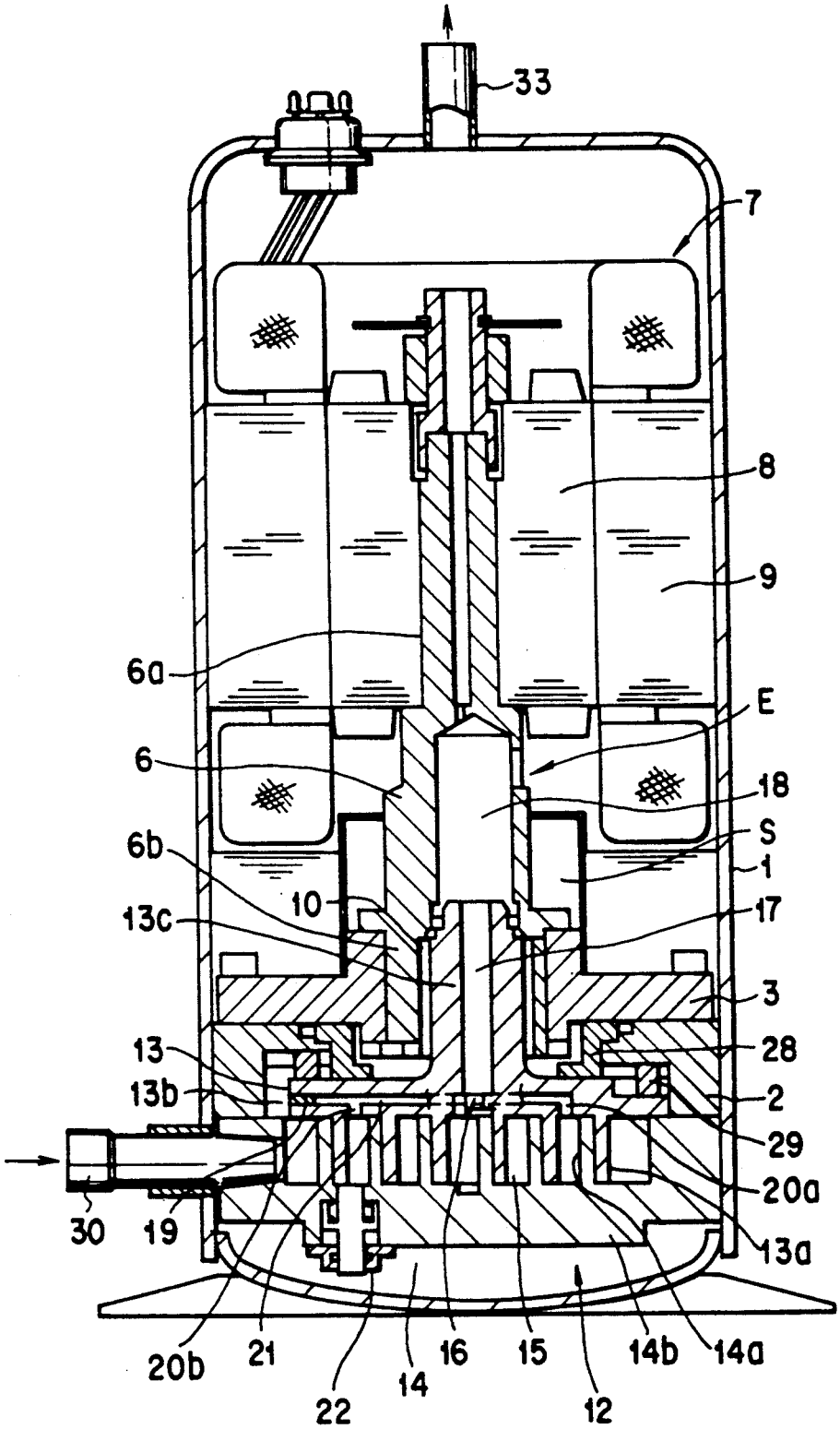

FIG. 1 shows a scroll type compressor used in, for example, a refrigerating cycle apparatus.

A support frame 2 is provided in a lower part of an elongated sealed casing 1.

A main bearing 3 is fixed to the support frame 2, and a rotary shaft 6 is journaled in the main bearing 3.

The rotary shaft 6 is vertically situated, and a main shaft portion 6*a* with a small diameter is formed at an upper part of the shaft 6.

A motor unit 7 is provided on the main shaft portion 6*a*.

The motor unit 7 comprises a rotor 8 mounted on the main shaft portion 6*a*, and a stator 9 fitted in the sealed casing 1 and having an inner peripheral surface with a small gap from the outer peripheral surface of the rotor 8.

The motor unit 7 is of the inverter type in which an operation frequency is controllable.

A lower part of the rotary shaft 6, which is journaled in the main bearing 3, is an eccentric portion 6*b* having a greater diameter than the main shaft portion 6*a*.

An eccentric hole 10 of a given length, which is eccentric to the rotary shaft 6, is provided to extend upward from the lower end face of the eccentric portion 6*b*.

A scroll compression mechanism 12 is coupled to the eccentric portion 6*b*.

The scroll compression mechanism 12 comprises a revolving scroll 13 having a boss portion 13*c* engaged in the eccentric hole 10, and a stationary scroll 14 fixed on the support frame 2.

The motor unit 7, the rotary shaft 6 and the eccentric portion 6*b* formed integral to the rotary shaft 6 constitute the revolving means S for revolving the revolving scroll 13.

The revolving scroll 13 comprises a blade portion 13*a* and a disc portion 13*b* (generally termed "mirror plate") which is integral to the blade portion 13*b*, and similarly the stationary scroll 14 comprises a blade portion 14*a* and a disc portion 14*b*.

The blade portions 13*a* and 14*a* are spiral platelike members and engaged with each other.

The blade portions 13*a* and 14*a* and disc portions 13*b* and 14*b* of the scrolls 13 and 14 define space portions or compression chambers 15 which will be described later.

A discharge port 16 is provided at a center of the disc portion 13*b* of the revolving scroll. The discharge port 16 communicates with a gas discharge passage 17 extending along the center axis of the boss portion 13*c*.

The gas discharge passage 17 communicates with the eccentric hole 10 of the rotary shaft 6 and with a gas guide hole 18 opening to the periphery of the rotary shaft 6.

The discharge port 16, gas discharge passage 17 and gas guide hole 18 constitute gas discharge means E.

On the other hand, the disc plate 13b of the revolving scroll is provided with a first inlet 20a and a second inlet 20b.

The opening end of one of the first and second inlets 20a and 20b is open to the bottom of the disc plate 13b provided with the blade portion 13a.

The opening end of the other inlet is connected to a communication path 21 extending within the disc plate 13b.

Accordingly, the inlets 20a and 20b and the compression chambers 15 communicating with the inlets 20a and 20b are connected to one another by the communication path 21.

The communication path 21 extends from the periphery of the disc plate 13b. A sealing member 19 is inserted in the opening end of the disc plate 13b, thereby sealing this opening.

The stationary scroll disc plate 14b is provided with a release mechanism 22 which constitutes release means.

Figure 2:
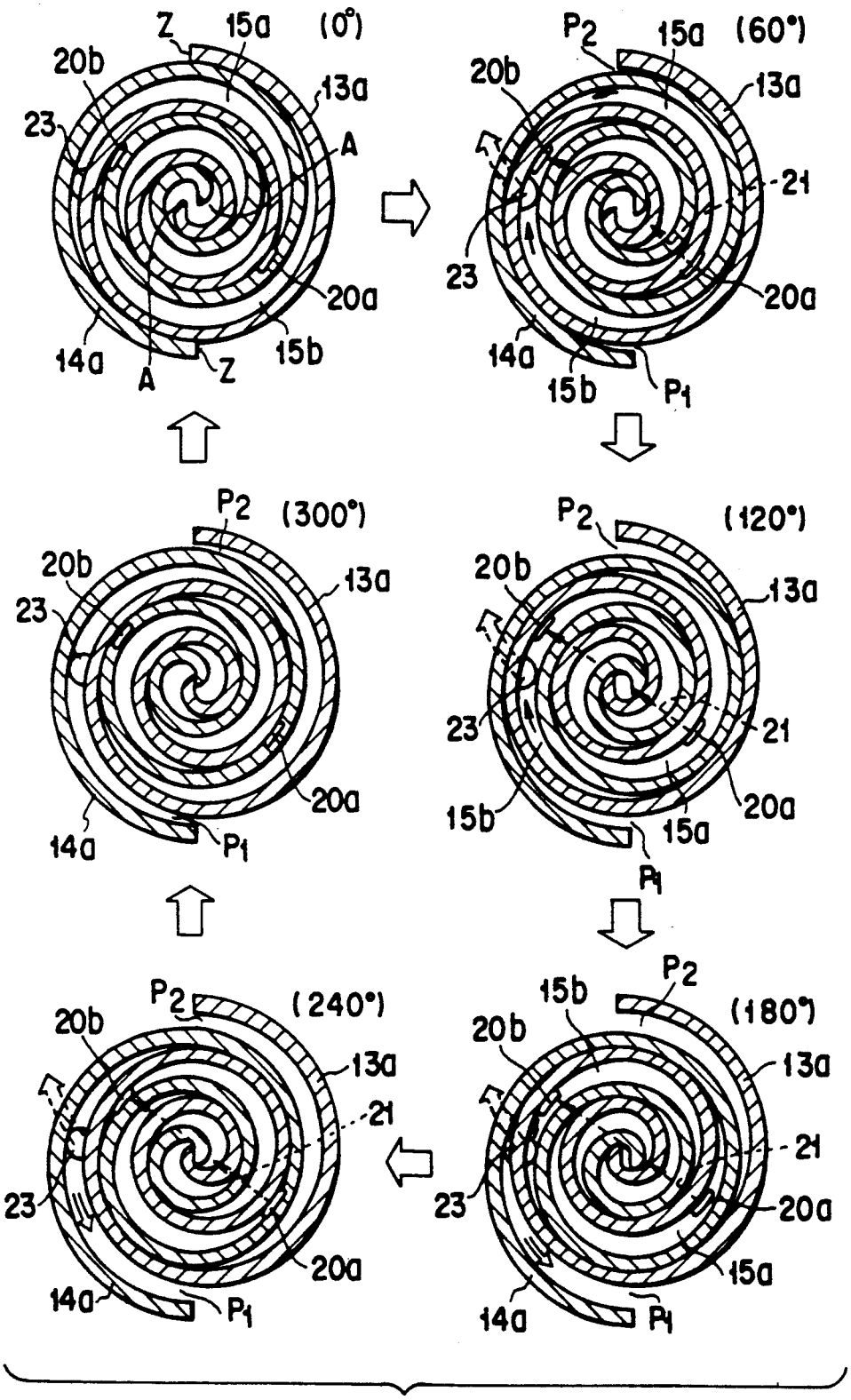

As is shown in FIG. 2, the first and second pressure chambers 15a and 15b having the equal pressure are always formed symmetrically in accordance with the revolution of the revolving scroll 13.

Specifically, when the revolving scroll 13 revolves, a pair of spaces P1 and P2 opening to the periphery are formed between spiral ends Z of the blade portions 13a and 14a of the revolving and stationary scrolls 13 and 14, on the one hand, and the peripheral walls of the facing blade portions 14a and 13a engaged with the blade portions 13a and 14b, on the other hand.

The spiral ends Z are the peripheral ends of the spiral blade portions 13a and 14a.

In FIG. 2, the spaces P1 and P2 begin to form at a rotational angle of 60°, and the distance between the spiral ends Z, on the one hand, and the facing peripheral walls of the blade portions 13a and 14a, on the other hand, is greatest at a rotational angle of 180°.

The distance decreases gradually and the spiral ends Z are brought into contact with the peripheral walls of the blade portions 14a and 13a over rotational angles 300° to 0°.

The peripheral portions of the scrolls 13 and 14 face gas suction means (described later). At the beginning, gas enters the spaces P1 and P2.

In accordance with the revolution of the revolving scroll 13, the spaces P1 and P2 are closed to form the first and second compression chambers 15a and 15b.

The first and second compression chambers 15a and 15b have an equal pressure. In accordance with the revolution of the revolving scroll 13, the chambers 15a and 15b move towards the spiral beginning points A of the scroll blade portions 13a and 14a by equal degrees.

The spiral beginning points A correspond to the center of the spiral of the spiral blade portions 13a and 14a.

At the same time, the volumes of the respective compression chambers 15a and 15b are gradually reduced. The degree of variation of the volume is equal in the respective chambers 15a and 15b and accordingly an equal pressure is always maintained in these chambers.

The first and second inlets 20a and 20b are formed at positions on the relatively low pressure side of the first and second compression chambers 15a and 15b.

The release mechanism 22 is provided at a position facing the second compression chamber 15b, at which the second inlet 20b is opened.

Since the revolving scroll 13 revolves, there is a situation, depending on the position of the blade portion 13a, in which part of the release mechanism 22 faces the first compression chamber 15a.

The position of the release mechanism 22 is not limited to the above, and it may be provided inside the spiral end Z of the stationary scroll blade portion 14a and in the range of 360° C. from the spiral end Z toward the spiral beginning point A.

FIG. 3 shows the structure of the release mechanism 22.

A release hole 23 penetrates the disc portion 14b of the stationary scroll.

A small-diameter portion 23a of the release hole 23 is open to the compression chamber 15, and a large-diameter portion 23b thereof is open to the outer surface of the disc portion 14b. A middle-diameter portion 23c of the release hole 23 is formed between the small-diameter portion 23a and the large-diameter portion 23b. These portions 23a, 23b and 23c communicate with each other coaxially.

A release valve 24 is movably contained within the release hole 23.

The release valve 24 has a valve body 24a which is movably contained in the large-diameter portion 23b of the release hole.

The valve body 24a, along with a spring 25, is movably contained in the large-diameter portion 23b. The valve body 24a is constantly urged towards the outside of the outer surface of the disc portion 14b by the spring 25.

A valve head 24b is formed at the upper side of the valve body 24a. The valve head 24b is slidably fitted in the small-diameter portion 23a of the release hole. The valve head 24b can open and close the small-diameter portion 23a in accordance with the movement of the valve body 24a.

The lower part of the valve body 24a has a small-diameter projection 24c. The projection 24c has such a length as to be able to project from the large-diameter portion 23b of the release hole.

The projection 24c is hermetically and slidably fitted in a valve receiver 26.

The valve receiver 26 is fixed on the lower-side surface of the stationary scroll disc portion 14b by a fixing member (not shown), and the valve receiver 26 seals the large-diameter portion 23b of the release hole.

An end of a by-pass port 32 communicates with part of the large-diameter portion 23b of the release hole. The other end of the by-pass port 32 is situated outside the outer periphery of the stationary scroll blade portion 14a.

The communication between the by-pass port 32 and the large-diameter portion 23b of the release hole is allowed and prevented in accordance with the vertical position of the release valve 24.

The release valve 24 is operated by driving means K to open/close the release hole 23.

The driving means K may utilize the pressure difference between the pressure in the compression chambers 15 and the pressure outside the stationary scroll blade portion 14b, or the suction pressure/discharge pressure of the compressor itself. Alternatively, the driving means K may be coupled to an electromagnetic valve.

Referring back to FIG. 1, a thrust ring 28 for receiving a thrust load is interposed between the rear surface of the revolving scroll disc portion 13b and the lower surface of the main bearing 3.

An Oldham ring 29 for restricting the rotation of the revolving scroll 13 about its own axis is interposed between the rear surface of the disc portion 13b and the support frame 2 on the peripheral side of the thrust ring 28.

A suction pipe 30 functioning as gas suction means is provided on the side portion of the sealed casing 1. The suction pipe 30 communicates with an evaporator (not shown) of the refrigerating cycle apparatus.

The suction pipe 30 is open to the outer periphery of the revolving and stationary scrolls 13 and 14.

On the other hand, a discharge pipe 33 communicating with a condenser (not shown) of the refrigerating cycle apparatus is connected to an upper end portion of the sealed casing 1. The discharge pipe 33 communicates with the inside of the sealed casing 1.

The operation of the scroll type compressor having the above structure will now be described.

When the rotary shaft 6 is rotated by the motor unit 7, the revolving scroll boss portion 13c engaged in the eccentric hole 10 revolves. Thus, the revolving scroll 13 revolves.

Evaporated low-pressure refrigerant gas is supplied from the evaporator of the refrigerating cycle apparatus into the scroll compression mechanism 12.

As has been described with reference to FIG. 2, the low-pressure refrigerant gas enters the open spaces P1 and P2 defined between the spiral ends Z of the revolving and stationary scroll blade portions 13a and 14a and the peripheral walls of the facing blade portions 14a and 13a engaged with the blade portions 13a and 14a.

In accordance with the revolution of the revolving scroll 13, the open spaces P1 and P2 are closed to form the first compression chamber 15a and second compression chamber 15b.

The compression chambers 15a and 15b move towards the spiral beginning points A of the scroll blade portions 13a and 14a by equal degrees.

The volumes of the paired compression chambers 15a and 15b are gradually reduced simultaneously, while the pressures in the chambers 15a and 15b are kept at equal levels. Thus, the gas in the chambers 15a and 15b is compressed.

When the chambers 15a and 15b move to the spiral beginning points A, the pressure of the refrigerant gas reaches a predetermined level, and the gas in the chamber 15a and the gas in the chamber 15b are made confluent.

The compressed high-pressure gas is discharged from the discharge port 16, shown in FIG. 1, and guided to the gas discharge passage 17. Further, the gas is passed through the gas guide hole 18 and filled within the sealed casing 1.

The high-pressure gas rises through the gap between the rotor 8 and stator 9 of the motor unit 7 and an oil return hole formed in the rotary shaft 6.

Thus, the high-pressure gas is discharged from the discharge pipe 33 at the upper end of the casing 1 to the condenser of the refrigerating cycle apparatus.

During this normal compression operation, the release mechanism 22 is not operated.

Figure 3A:
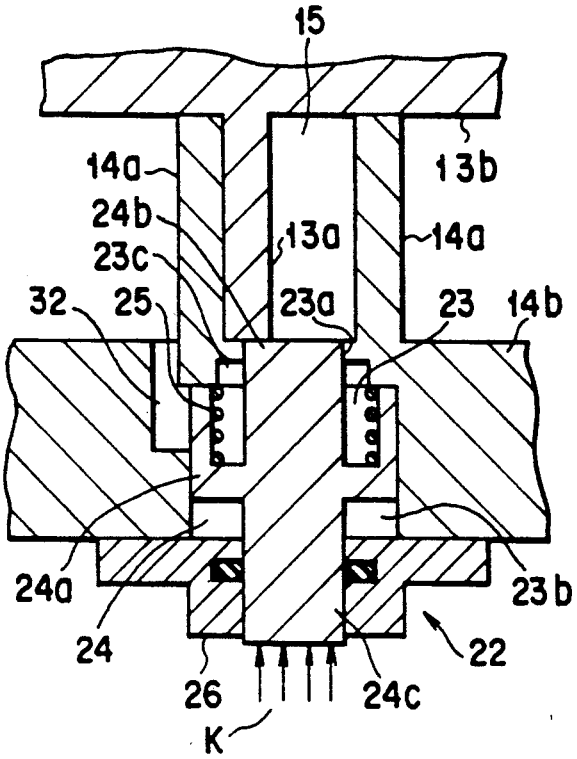
FIG. 3A illustrates a release mechanism at the time of normal operation.

FIG. 3A illustrates this state of the release mechanism.

The release valve 24 is urged against the elastic force of the spring 25 by the driving means K.

The valve head 24b of the release valve 24 is fitted in the small-diameter portion 23a of the release hole 23, thereby closing the bottom surface of the blade portion 14a of the stationary scroll disc portion 14a.

Accordingly, the first and second compression chambers 15a and 15b communicating with the first and second inlets 20a and 20b communicate only with each other via the inlets 20a and 20b and communication path 21.

The compression volumes in the compression chambers 15a and 15b do not vary, and the compression operation is not influenced.

When the compression ratio is varied according to the load, the release mechanism 22 is operated.

Figure 3B:
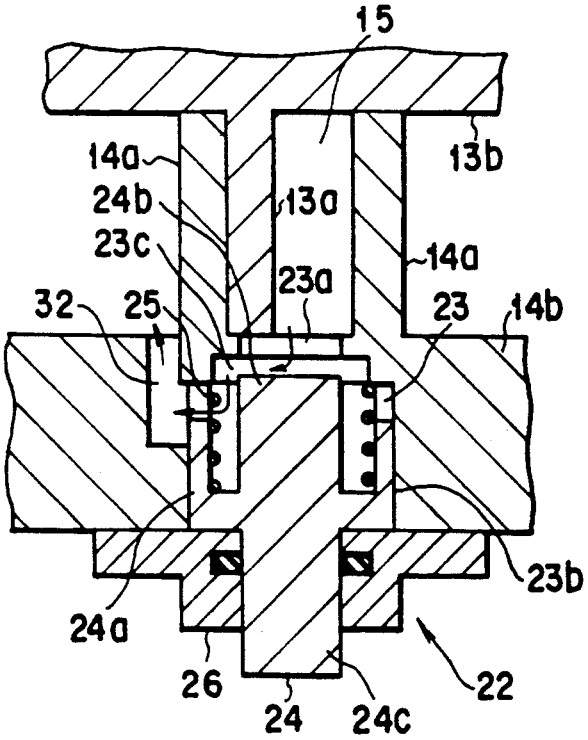
FIG. 3B illustrates the release mechanism at the release time.

Specifically, as shown in FIG. 3B, the operation of the driving means K is simply stopped.

Then, the elastic force of the spring 25 acts to lower the release valve 24.

The valve head 24b of the release valve 24 opens the small-diameter portion 23a, and the valve body 24a opens the opening end of the by-pass port 32.

The compression chamber 15 facing the release mechanism 22 communicates with the outer periphery of the stationary scroll blade portion 14a through the opened release hole 23 and by-pass port 32.

In FIG. 2, the state of the rotational angle 0° is shown in the upper left view.

In this state, the refrigerant gas has been sucked in the first and second compression chambers 15a and 15b, and the compression operation is ready to start.

Then, the revolving scroll blade portion 13a revolves, as indicated by the arrow, and changes its position relative to the stationary scroll blade portion 14a.

Since the release hole 23 is opened, part of the gas in the second compression chamber 15b is released directly from the release hole 23 to the outer peripheral region of the blade portion 14a (functioning as the gas suction unit) at the rotational angle of 60°.

Further, part of the gas in the first compression chamber 15a is released directly from the release hole 23, and part of the gas is temporarily guided into the second compression chamber 15b successively through the first inlet 20a, communication path 21 and second inlet 20b and then released from the release hole 23.

At the rotational angle of 120°, the gas in the second compression chamber 15b is led to the release hole 23 directly, and the gas in the first compression chamber 15a guided successively through the first inlet 20a, communication path 21 and second inlet 20b and then released via the second compression chamber 15b and release hole 23.

The state of the rotational angle of 180° is substantially identical to that of the rotational angle of 120°.

At the rotational angle of 240°, both compression chambers 15a and 15b are completely separated from the release hole 23, and the release operation is temporarily completed.

The state of the rotational angle of 360° is identical to that of the rotational angle of 0°, and a similar operation is repeated.

By virtue of the above release operation, the compression ratio can be varied in accordance with the load although the present compressor is of the scroll type, with the result that the stress on the blade portions 13a and 14a is reduced and the compression performance is enhanced.

Further, the variation of the compression ratio means the variation of the compression performance. Thus, the present compressor is advantageous for low-speed driving and continuous driving.

Moreover, an equal amount of gas can exactly be released from the two compression spaces, i.e. the first and second compression chambers 15*a* and 15*b*.

These operations can be carried out with a relatively simple structure, by using the single release mechanism 22, and the release efficiency can remarkably be enhanced.

The release mechanism 22 is situated inside the spiral end Z of the stationary scroll blade portion 14*a* and in the range of 360°. Thus, after the release operation is completed in the first and second compression chambers 15*a* and 15*b*, the compression operation is performed.

Accordingly, a high release rate is maintained without degrading the compression efficiency.

The position of the release mechanism 22 may be near the spiral end Z of the stationary scroll blade portion 14*a*.

In this case, the formation of the release hole 23 becomes easier. On the other hand, since the release hole 23 is situated at a position very close to the end of the compression space, the release rate decreases, as compared to the case where the release hole 23 is situated inside the spiral end Z and in the range of 360°.

Figure 4:
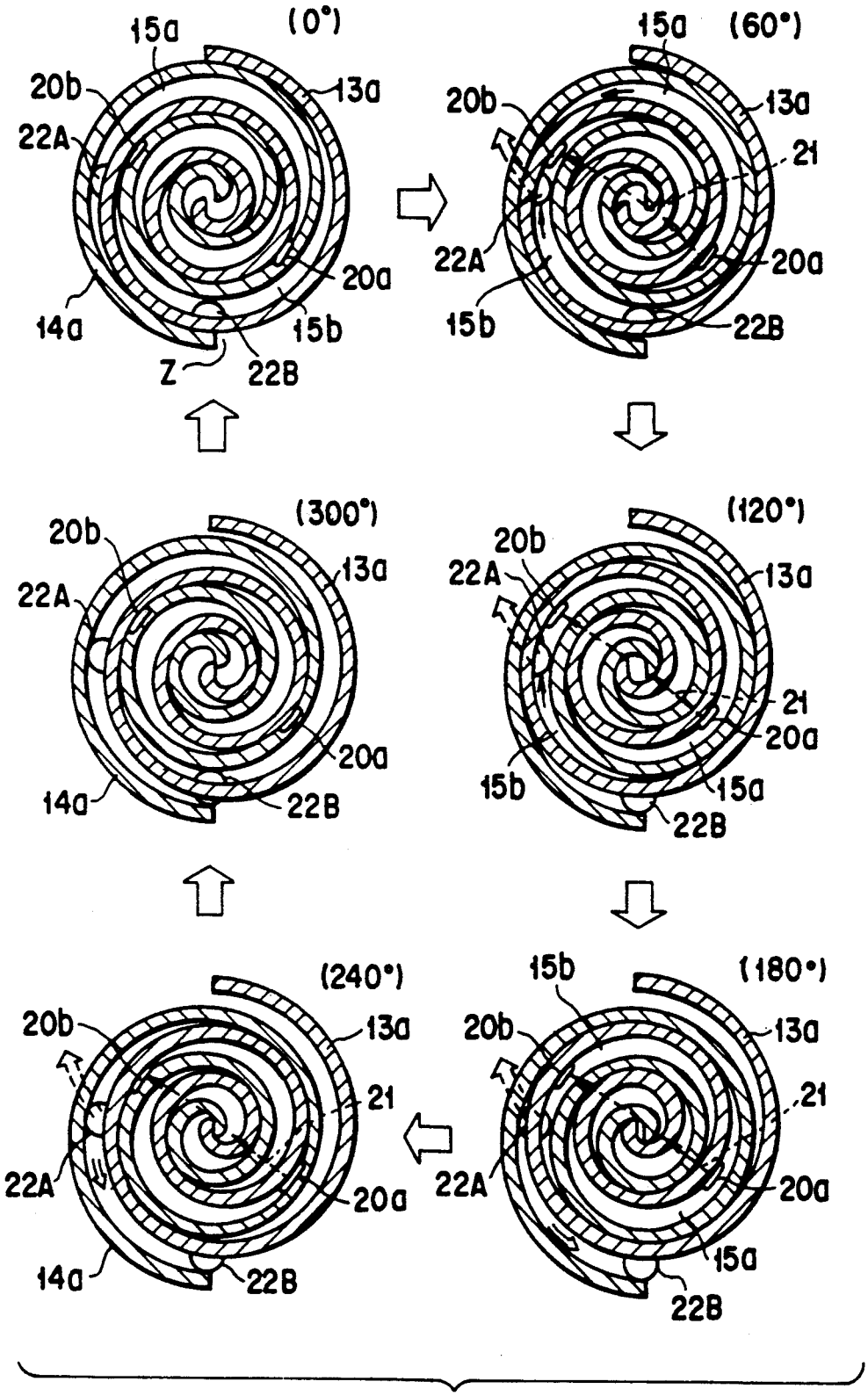
FIG. 4 illustrates the sequence of a release operation in another embodiment of the invention.

FIG. 4 illustrates the sequence of the release operation in the case where the release means is constituted by a first release mechanism 22A and a second release mechanism 22B.

The first release mechanism 22A is situated inside the spiral end Z of the stationary scroll blade portion 14*a* and in the range of 360°, and the second release mechanism 22B is situated near the spiral end Z of the stationary scroll blade portion 14*a*.

The structure of the first release mechanism 22A may be the same as that of the release mechanism 22 shown in FIG. 3.

Figure 5A:
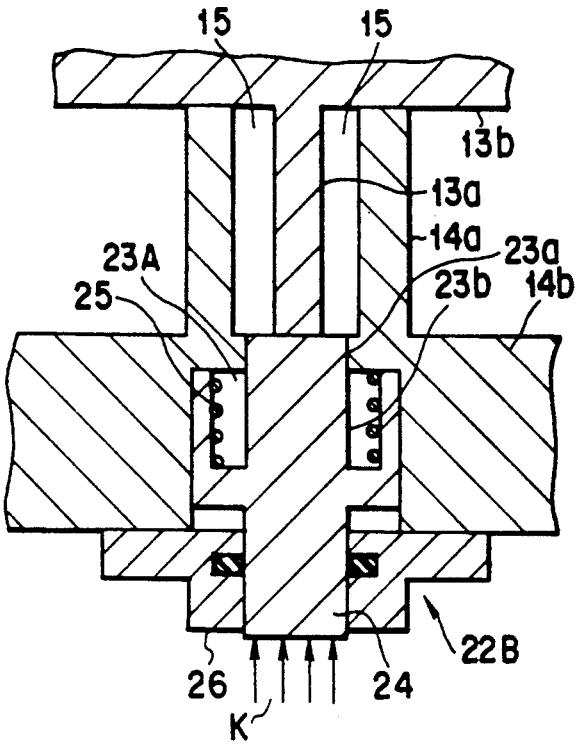
FIG. 5A illustrates a release mechanism at the time of normal operation in the embodiment of FIG. 4.
Figure 5B:
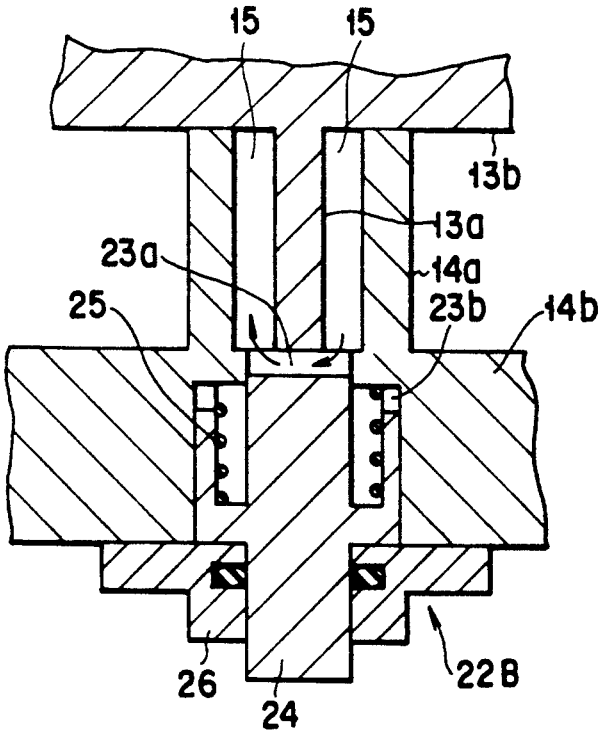
FIG. 5B illustrates the release mechanism at the release time.

The second release mechanism 22B is constructed, as shown in FIGS. 5A and 5B.

Specifically, the release valve 24, spring 25, valve receiver 26 and driving means K are common to those described above.

A release hole 23A is formed such that a small-diameter portion 23*a* adjoins a large-diameter portion 23*b*.

FIG. 5A illustrates the normal operation state. The valve head 24*b* of the release valve 24 closes the small-diameter portion 23*a*, and the compression operation is not influenced at all.

FIG. 5B illustrates the release operation state.

When the driving means K is stopped and the driving force is lost, the elastic force of the spring 25 acts and the valve head 24*b* of the release valve 24 opens the opening end of the small-diameter portion 23*a*.

At this time, the release hole 23A is defined by the revolving scroll blade portion 13*a* so as to face both compression chambers 15.

Referring back to FIG. 4, the first release mechanism 22A performs the same function as the release mechanism 22 described with reference to FIG. 2.

However, in the case of the first release mechanism 22A, the release amount from the second compression chamber 15*b* over rotational angles 0° to 60° is very small because of the position of the mechanism 22A.

By contrast, the second release mechanism 22B is positioned such that gas is smoothly released from the second compression chamber 15*b* over the same range of angles. That is, the opening end of the release hole 23A is defined by the revolving scroll blade portion 13*a* so as to face both pressure chambers 15.

In FIG. 5B, the inside compression chamber 15 corresponds to the second pressure chamber 15*b*, and the outside compression chamber 15 faces the gas suction unit. Thus, in the range of rotational angles 0° to 60°, in particular, the loss in gas pressure is reduced in the second compression chamber 15*b* and useless compression is prevented, thereby maintaining good release efficiency.

Figure 6:
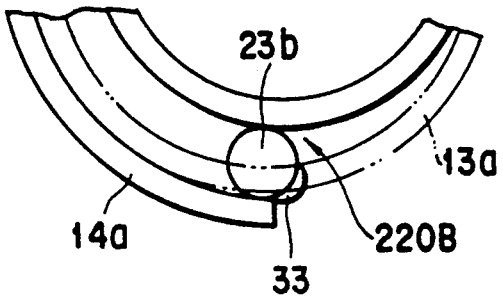
FIG. 6 is a plan view of a release mechanism according to another embodiment.
Figure 7:
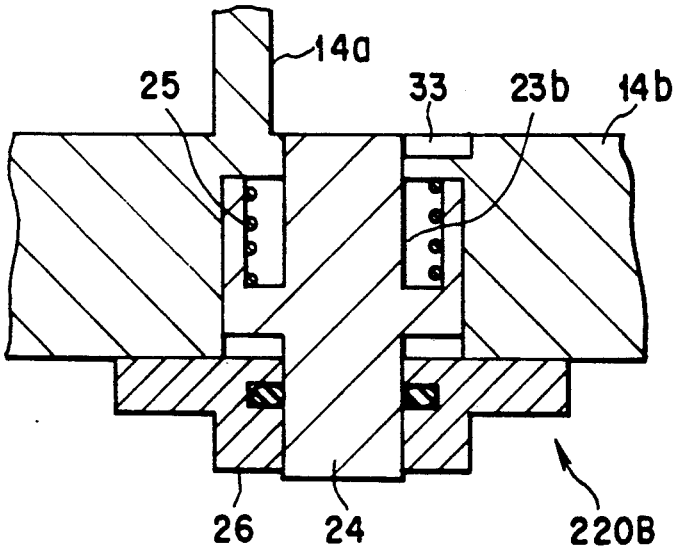
FIG. 7 is a vertical cross-sectional view of the release mechanism shown in FIG. 6.

FIGS. 6 and 7 show a modified second release mechanism 220B.

In this modification, the release valve 24, spring 25 and valve receiver 26 are common to those described above.

In the modification, a lap groove 33 is newly provided. The lap groove 33 communicates with the opening end of the release hole 23 on the side of pressure chamber 15 and extends to the gas suction-side portion.

In the normal non-release condition, the compression efficiency is not influenced, like the above-described embodiments.

In the release mode, the total area of the release hole 23*b* and lap groove 33 is opened, and the gas in the compression chamber 15 is immediately guided to the gas suction unit. Thus, the loss in pressure is reduced.

Figure 8:
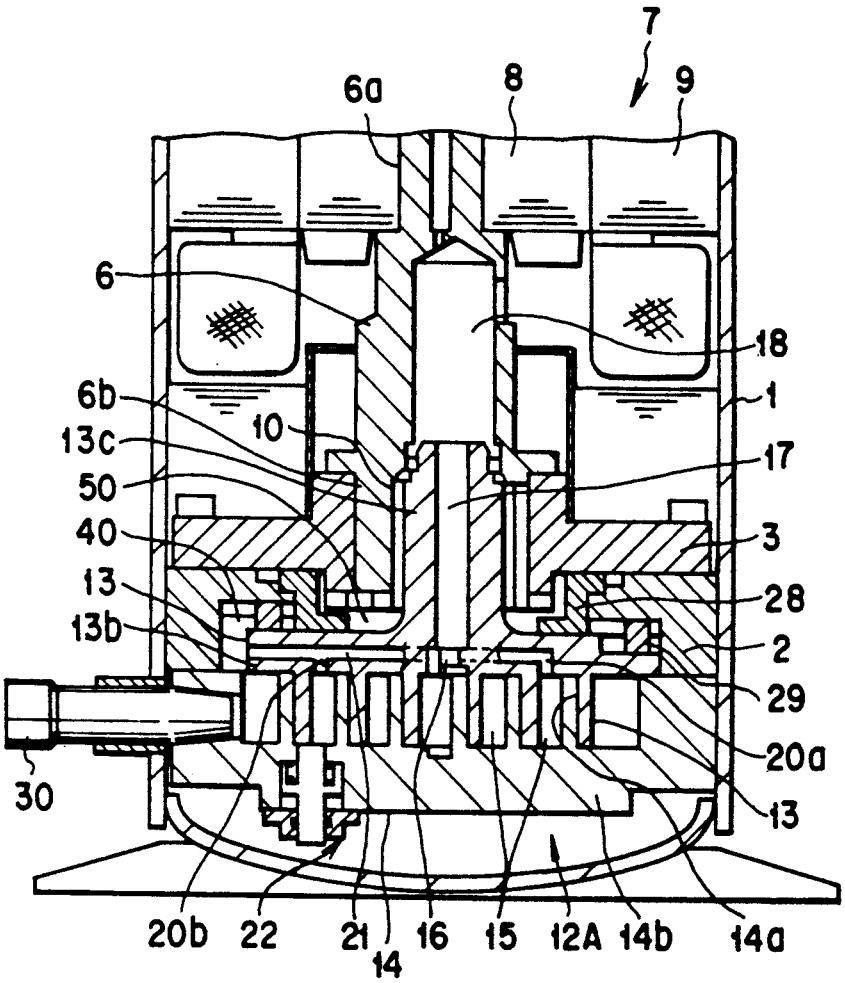
FIG. 8 is a partially omitted vertical cross-sectional view of a scroll type compressor according to another embodiment of the invention.

A scroll type compressor, as shown in FIG. 8, may be employed.

The compressor shown in FIG. 8 differs from that shown in FIG. 1 in that one end of the communication path 21 is open to the peripheral surface of the disc portion 13*b* of the revolving scroll 13.

The other structural features are identical to those of the compressor of FIG. 1. Accordingly, the position of the communication path 21, positions of first and second inlets 20*a* and 20*b* communicating with the communication path 21 and structure of the release mechanism 22 are common.

The thrust ring 28 divides the space defined between the peripheral surface and rear surface of the revolving scroll disc portion 13*b* and the main bearing 3, into an inner peripheral portion and an outer peripheral portion.

Since the outer peripheral portion of the space communicates with the opening end of the communication path 21, this portion is referred to as an intermediate pressure chamber 40. On the other hand, since the inner peripheral portion of the space communicates with the inside of the sealed casing 1 with a gap remaining between the main bearing 3 and the eccentric portion 6*b*, this portion is referred to as a high pressure chamber 50.

With the scroll compression mechanism 12A having the above structure, in the normal compression operation, part of the compressed gas in the equal-pressure compression chambers 15 is guided from the first and second inlets 20*a* and 20*b* simultaneously by equal degrees.

Since the communication path 21 communicates with the intermediate pressure chamber 40 defined at the periphery of the disc portion 13*b*, the gas being compressed is guided to the intermediate pressure chamber 40 through the communication path 21.

In the state wherein the gas pressure in the compression chambers 15 communicating with the first and second inlets 20*a* and 20*b* is lower than the gas pressure in the intermediate pressure chamber 40, the gas in the intermediate pressure chamber 40 returns to the compression chambers 15 through the communication path 21 and inlets 20*a* and 20*b*.

Accordingly, the compression chambers 15 communicating with the inlets 20*a* and 20*b* can always be kept at equal pressure level.

The gas which is guided, while being compressed, to the intermediate pressure chamber applies pressure to the peripheral surface and rear surface of the revolving scroll disc portion 13*b*. This pressure is referred to as an intermediate pressure, since the gas is being compressed.

The intermediate pressure applied to the peripheral surface of the disc portion 13*b* does not act on the revolving scroll 13, whereas the intermediate pressure applied to the rear surface of the disc portion 13*b* urges the revolving scroll 13 in the axial direction.

Specifically, while the intermediate pressure chamber 40 is filled with gas, pressure acts on the rear surface of the revolving scroll disc portion 13*b*, thereby forcibly making a seal between the tips of the respective scroll blade portions 13*a* and 14*a* and the facing scroll disc portions 13*b* and 14*b*.

On the other hand, part of high-pressure gas discharged to, and filled in, the inside of the sealed casing 1 is guided to the high pressure chamber 50. Thus, the chamber 50 is kept at high pressure.

Thus, a high backing pressure acts on the rear surface of the revolving scroll disc portion 13*b*, in particular, the periphery of the boss portion 13*c*, thereby ensuring a seal between the scrolls 13 and 14.

Figure 9:
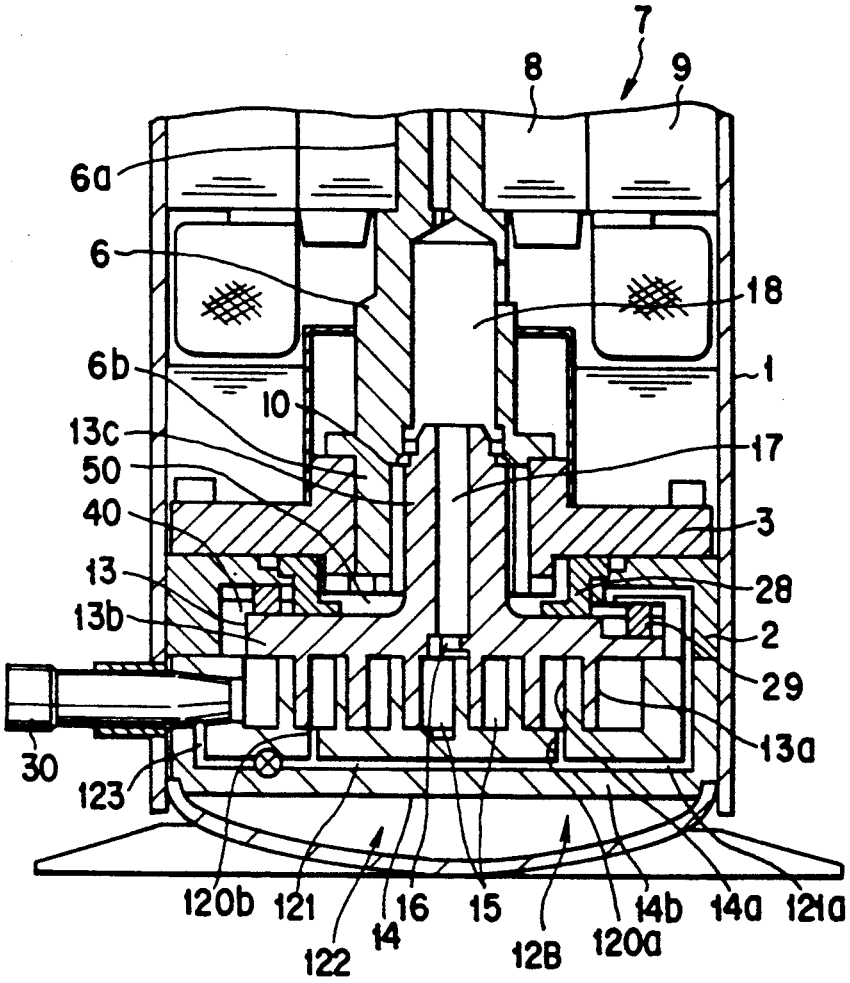
FIG. 9 is a partially omitted vertical cross-sectional view of a scroll type compressor according to another embodiment of the invention.

A scroll compression mechanism, as shown in FIG. 9, may be employed.

In this case, a pair of inlets 120*a* and 120*b* are formed in the stationary scroll disc portion 14*b*.

The lower open ends of the inlets 120*a* and 120*b* communicate with a communication path 121 extending in the disc portion 14*b*.

An end portion of a communication branch 121*a* communicates with a connection point between the communication path 121 and inlet 120*a*.

The branch 121*a* extends in the disc portion 14*b* towards its peripheral end, and turns upwards at a point outside the peripheral end of the revolving scroll disc portion 13*b* into the support frame 2. In the support frame 2, the branch 121*a* further turns horizontally and opens to a point between the thrust ring 28 and Oldham ring 29.

Accordingly, an intermediate pressure chamber 40 is formed at the outer periphery of the thrust ring 38; on the other hand, a high pressure chamber 50 is formed at the inner periphery of the thrust ring 28.

An end portion of a branch 123 communicates with a connection point between the communication path 121 and inlet 120*b*.

The branch 123 extends in the disc portion 14*b* and communicates directly with the suction pipe 30.

A release mechanism 122 (e.g. an electromagnetic valve) for opening and closing the communication path 121 is provided in the branch 123.

With this structure, too, part of the gas in the equal-pressure compression chambers 15, which is being compressed, can be led to the communication path 121 via the mutually communicating inlets 120*a* and 120*b* simultaneously by equal degrees The gas is guided from the communication path 121 to the intermediate pressure chamber 40 and exerts intermediate pressure on the rear surface of the revolving scroll disc portion 13*b*.

Accordingly, with this structure, too, sealing between the revolving scroll 13 and stationary scroll 14 can be ensured.

When the release mechanism 122 constituted by the electromagnetic valve is opened, the gas passing through the communication path 121, which is being compressed, can be led directly to the suction pipe 30. Thus, a high-pressure release can be effected, and the compression ratio can be varied according to the load.

The structural elements of the scroll type compressor shown in FIG. 9, which are identical to those shown in FIG. 1, are denoted by like reference numerals, and descriptions thereof are omitted.

The above-described scroll type compressors are applicable not only to the refrigerating cycle apparatus but also to other apparatuses and systems.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A scroll type compressor wherein compression chambers are formed between a stationary scroll and a revolving scroll to perform a compression function, said compressor comprising:

a revolving member;

a revolving scroll coupled to the revolving member, the revolving scroll including a first disc portion and a first plate-like spiral blade portion projection from one side surface of the disc portion;

a stationary scroll including a second disc portion and a second plate-like spiral blade portion projecting from one side surface of the second disc portion, the second blade portion being engaged with the first blade portion of the revolving scroll, said first and second blade portions and said first and second disc portions being arranged to define first and second compression chambers, said first and second compression chambers being defined between the second blade portion and the second disc portion of the stationary scroll, and between the first blade portion and the first disc portion of the revolving scroll, said first and second compression chambers having equal pressures constantly;

gas suction means for sucking and guiding a gas to be compressed, the gas suction means facing the outer peripheral portions of the stationary scroll and revolving scroll;

gas discharge means for discharging and guiding the compressed gas, the gas discharge means facing the center of the spiral of the blade portions of the stationary scroll and revolving scroll, said first and second compression chambers taking in the gas guided from the gas suction means from outside spiral ends of the blade portions of the stationary and revolving scrolls in accordance with the revolving motion of the revolving scroll, moving towards the center of the spiral of the respective blade portions, reducing their volumes gradually, compressing the gas, and discharging the gas to the gas discharge means;

a first inlet opening into the first compression chamber and a second inlet opening to the second compression chamber, said first and second inlets being defined at locations where the gas is being compressed;

a communication path for communication between the first and second inlets; and a release mechanism capable of opening and closing between one of the first and second compression chambers and the gas suction means, the release mechanism returning, in the open state, part of the gas in one of the first and second compression chambers directly to, and part of the gas in the other compression chamber via the first and second inlets, the communication path and said one of the compression chambers to, the gas suction means simultaneously by equal degrees, said first and second inlets and said communication path being formed in the revolving scroll disc portion, and said release mechanism being provided on the stationery scroll disc portion.

2. The compressor according to claim 1, wherein said revolving member comprises a motor unit, a rotary shaft coupled to and rotated by the motor unit, an eccentric portion provided on the rotary shaft and engaged with the disc portion of the revolving scroll, and an Oldham ring for restricting rotation of the revolving scroll about its own axis.

3. The compressor according to claim 1, wherein said revolving member, said gas suction means, said gas discharge means, said revolving scroll, said stationary scroll and said release mechanism are all contained within a sealed casing.

4. The compressor according to claim 3, wherein said gas suction means comprises a suction pipe penetrating the sealed casing, and said release mechanism guides, in the open state, the gas in both compression chambers to an area between the open end of the suction pipe and the outside spiral end portion of each of the scroll blade portions.

5. The compressor according to claim 1, wherein said release mechanism is provided at a position corresponding to the first and second compression chambers, which the open ends of the first and second inlets face, and inside the spiral end portion of the stationary scroll blade portion in the range of 360° from this spiral end portion towards the spiral center, such that the compression operation starts after the release operation is completed.

6. The compressor according to claim 1, wherein said release mechanism comprises:

a release hole penetrating the disc portion of the stationary scroll and having one end opened to one of the first and second compression chambers;

a by-pass port for communication between the release hole and the gas suction means;

a release valve fitted slidably in the release hole, the release valve being capable of opening and closing between the release hole and the by-pass port; and driving means for driving the release valve to allow and prohibit communication between the release hole and the by-pass hole.

7. The compressor according to claim 6, wherein said release hole has a small-diameter portion opening to the compression chamber, a large-diameter portion opening to the outer surface of the disc portion, and an intermediate-diameter portion between the large-diameter portion and the small-diameter portion, these portions being axially provided, wherein said by-pass port allows communication between the large-diameter portion of the release hole and the gas suction means, and wherein said release valve has one end portion capable of closing and opening the small-diameter portion of the release hole, and a peripheral surface capable of closing and opening the by-pass port.

8. The compressor according to claim 6, wherein an end portion of said release valve always projects outward from the disc portion of the stationary scroll, and the outer surface of the disc portion of the stationary scroll is provided with a valve receiver in which the projecting end portion of the release valve is fitted slidably and hermetically.

9. The compressor according to claim 6, wherein said driving means is at least one of mechanism which utilizes a pressure difference between the pressure in the compression chamber communicating with the release hole and the pressure outside the stationary scroll, mechanism which utilizes the suction pressure and discharge pressure of the compressor, and means which comprises an electromagnetic valve.

10. The compressor according to claim 6, wherein a lap groove communicating with the open end of the release hole is formed in that surface of the revolving scroll disc portion, which faces the compression chamber, and the total area of the release hole and the lap groove is opened when the release valve is opened.

11. The compressor according to claim 1, wherein said release mechanism is situated near the spiral end portion of the stationary scroll blade portion.

12. The compressor according to claim 11, wherein said release mechanism comprises:

a release hole formed in the disc portion of the stationary scroll and having one open end communicating with an area divided into a compression chamber-side portion and a suction-side portion by the blade portion of the revolving scroll;

a release valve fitted slidably in the release hole, the release valve being capable of opening and closing the release hole; and driving means for opening and closing the release valve.

13. The compressor according to claim 12, wherein said release hole has a small-diameter portion opening to the compression chamber, and a large-diameter portion opening to the outer surface of the disc portion, these portions being axially provided, and wherein said release valve has one end portion capable of closing and opening the small-diameter portion of the release hole.

14. The compressor according to claim 1, wherein said release mechanism comprises a first release mechanism situated inside the spiral end portion of the stationary scroll blade portion in the range of 360° from the spiral end portion, and a second release mechanism situated near the spiral end portion of the stationary scroll blade portion, said first and second release mechanisms being opened thereby always guiding gas from one of the release mechanisms, irrespective of the rotation angle of the rotary shaft.

15. A scroll type compressor wherein compression chambers are formed between a stationary scroll and a revolving scroll to perform a compression function, said compressor comprising:

a revolving member;

a revolving scroll coupled to the revolving member, the revolving scroll including a first disc portion and a first plate-like spiral blade portion projection from one side surface of the disc portion;

a stationary scroll including a second disc portion and a second plate-like spiral blade portion projecting from one side surface of the second disc portion, the second blade portion being engaged with the first blade portion of the revolving scroll, said first and second blade portions and said first and second disc portions being arranged to define first and second compression chambers, said first and second compression chambers being defined between the second blade portion and the second disc portion of the stationary scroll, and between the first blade portion and the first disc portion of the revolving scroll, said first and second compression chambers having equal pressures constantly;

gas suction means for sucking and guiding a gas to be compressed, the gas suction means facing the outer peripheral portions of the stationary scroll and revolving scroll;

gas discharge means for discharging and guiding the compressed gas, the gas discharge means facing the center of the spiral of the blade portions of the stationary scroll and revolving scroll, said first and second compression chambers taking in the gas guided from the gas suction means from outside spiral ends of the blade portion of the stationary and revolving scrolls in accordance with the revolving motion of the revolving scroll, moving towards the center of the spiral of the respective blade portions, reducing their volumes gradually, compressing the gas, and discharging the gas to the gas discharge means;

a first inlet opening into the first compression chamber and a second inlet opening to the second compression chamber, said first and second inlets being defined at locations where the gas is being compressed;

a communication path for communication between the first and second inlets; and a release mechanism capable of opening and closing between one of the first and second compression chambers and the gas suction means, the release mechanism returning, in the open state, part of the gas in one of the first and second compression chambers directly to, and part of the gas in the other compression chamber via the first and second inlets, the communication path and said one of the compression chambers to, the gas suction means simultaneously by equal degrees, said communication path having a communication branch for guiding part of the gas in the first and second compression chambers to the rear side of the revolving scroll disc portion, and the gas guided through the communication branch extending a backing pressure to the revolving scroll, thereby forcibly maintaining a seal between the tip portions of the scroll blade portions and the facing scroll disc portions.

16. The compressor according to claim 15, wherein a thrust ring for receiving a thrust load of the revolving scroll is provided on the rear side of the revolving scroll disc portion, an inner peripheral region of the thrust ring constitutes a high pressure chamber into which a high-pressure gas discharged from the gas discharge means is fed, and an outer peripheral region constitutes an intermediate pressure chamber filled with a gas guided from the communication branch.

17. The compressor according to claim 15, wherein said first and second inlets and said communication path are formed in the revolving scroll disc portion, said communication branch opens to the peripheral surface of the revolving scroll disc portion, and said release mechanism is provided on the stationary scroll disc portion.

18. The compressor according to claim 15, wherein said first and second inlets and said communication path are formed in the stationary scroll disc portion, said communication branch extends from the stationary scroll disc portion towards the rear side of the revolving scroll disc portion, and said release mechanism is provided on the stationary scroll disc portion.

19. The compressor according to claim 18, wherein said communication path and said gas suction means are made to communicate with each other via the communication branch, and the release mechanism is provided midway along the communication branch.

* * * * *